166-308 SR
1/5/88 XR 4,716,932

United States Patent [19]

Adams, Jr.

[11] Patent Number: 4,716,932

[45] Date of Patent: Jan. 5, 1988

[54] CONTINUOUS WELL STIMULATION FLUID BLENDING APPARATUS

[76] Inventor: Harmon L. Adams, Jr., 15006 Carols Way, Houston, Tex. 77070

[21] Appl. No.: 19,740

[22] Filed: Feb. 27, 1987

[51] Int. Cl.[4] ..... E21B 43/267

[52] U.S. Cl. ..... 137/566; 137/572; 137/597; 137/861; 137/897; 166/308

[58] Field of Search ..... 137/566, 571, 572, 597, 137/861, 896, 897; 166/280, 308

[56] References Cited

U.S. PATENT DOCUMENTS

| | | | |
|---|---|---|---|
| 3,486,560 | 12/1969 | Hutchison et al. | 166/308 X |
| 3,722,595 | 3/1973 | Kiel | 166/308 |
| 3,766,986 | 10/1973 | Kiel | 166/308 |
| 3,980,136 | 9/1976 | Plummer et al. | 166/308 X |
| 4,126,181 | 11/1978 | Black | 166/308 X |
| 4,512,405 | 4/1985 | Sweatman et al. | 166/308 X |
| 4,569,394 | 2/1986 | Sweatman et al. | 166/308 X |
| 4,635,727 | 1/1987 | Anderson et al. | 166/308 |
| 4,665,982 | 5/1987 | Brown | 166/308 X |

*Primary Examiner*—Alan Cohan
*Assistant Examiner*—John Rivell
*Attorney, Agent, or Firm*—Fulbright & Jaworski

[57] ABSTRACT

A blender pump receiving a supply of base fluid and discharging the fluid into a particle mixing vat. A throttle valve and an input flow meter are connected to the discharge of the throttle valve. A gelling unit has its inlet connected to the blender pump discharge upstream of the throttle valve and the output of the gelling unit is connected to the upstream side of the throttle valve and downstream of the gelling unit inlet. The gelling unit includes a mixing eductor with at least one dry chemical gel feeder and a dispensing pump having a higher outlet pressure than the blender pump discharge pressure. A flow meter and valve is connected to the output of the dispensing pump for measuring and controlling the flow rate through the gelling unit.

9 Claims, 3 Drawing Figures

CONTINUOUS WELL STIMULATION FLUID BLENDING APPARATUS

BACKGROUND OF THE INVENTION

Various types of well stimulation fluids are used in hydraulically fracturing of oil and/or gas wells to enlarge or create new well formation fractures making it possible for oil and/or gas to move more readily to a well bore. A fracturing or frac fluid is hydraulically injected into the well and generally includes various gelling agents to thicken the fluid and reduce friction and includes selected particles or propping agents to hold the fracture open after the applied pressure is relieved, and may contain a wide variety of chemical additives to overcome different types of well formation conditions which may be encountered. The base fluid may contain various combinations of fresh or salt water, various hydrocarbons or well fluids. Many types of gelling agents are used such as synthetic polymers and guar gum. The propping agents may be sand, prepared particles, or ground up walnut shells. The chemical additives may include acids, breakers, friction reducers, surfactants, and other dry and wet chemical aids.

It has been conventional to combine the gelling agents and the base fluid in tanks prior to commencing the fracing operation. Upon commencing the operation, the combined gel and base fluid was pumped into a mixing vat for combining with the propping articles and the mixed slurry was then pumped to the frac pumps for injection into the well. However, this process required that the combined base fluid and gel be premixed, which is a considerable expense. Furthermore, the gelled fluid is expensive and if the operation is stopped or the gelled fluid is not all used, another expense is incurred along with the expense and trouble of disposing of the unused gelled fluid. Furthermore, the stored gelled fluid is subject to degradation.

The present invention is generally directed to an apparatus for blending all of the well stimulation fluids used for hydraulic fracturing while proportioning and mixing the required components of the stimulation fluid as the hydraulic fracturing operation proceeds.

SUMMARY

The present invention is directed to a well stimulation fluid blending apparatus which includes a blender suction pump having a suction intake adapted to be connected to a supply of base fluid and having a discharge outlet. A throttle valve is connected to the discharge outlet of the blender pump and an input flow meter is connected to the discharge outlet downstream of the throttle valve for measuring fluid flow and a particle mixing vat is connected to the discharge outlet downstream of the flow meter. A gelling unit is provided having an inlet and an outlet. Preferably, the inlet of the gelling unit is connected to the discharge outlet of the blender pump at a point upstream of the throttle valve and the output of the gelling unit is connected to the upstream side of the throttle valve but downstream of the inlet of the gelling unit. The gelling unit includes a mixing eductor positioned between the inlet and the outlet of the gelling unit with at least one dry chemical gel feeder connected to the eductor for feeding gel into the eductor for mixing with incoming base fluid. A dispensing pump is connected between the mixing eductor and the gelling unit output which has a higher outlet pressure capacity than the discharge pressure of the blender pump for inserting the mixture of gelled fluid downstream of the blender pump. A flow meter and valve is connected to the output of the dispensing pump for measuring and controlling the flow rate through the gelling unit.

Still a further object of the present invention is the provision of a discharge manifold connected to the outlet of the dispensing pump having a volume sufficient for holding the mixture of gel and base fluid a length of time sufficient for the gel to hydrate prior to reaching the outlet of the gelling unit.

Still a further object of the present invention is the provision of a receiving pump connected between the gelling unit inlet and the mixing eductor and valves in the gelling unit inlet and outlet for emptying the gelling unit of materials.

Still a further object of the present invention is wherein the mixing eductor is a circular tank having a tangentially directed inlet port for receiving the base fluid, and liquid level measuring means in the tank. Valve means are connected to the inlet port and to the liquid level measuring means for controlling the fluid level in the tank. Preferably the tank includes an outlet port at a lower elevation than the inlet port.

Yet a still further object of the present invention is wherein the discharge mainfold includes an openable and closable air vent for allowing pumping fluids out of the manifold.

Still a further object of the present invention is the provision of at least one chemical liquid pump which is connected to the inlet of the blender pump.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
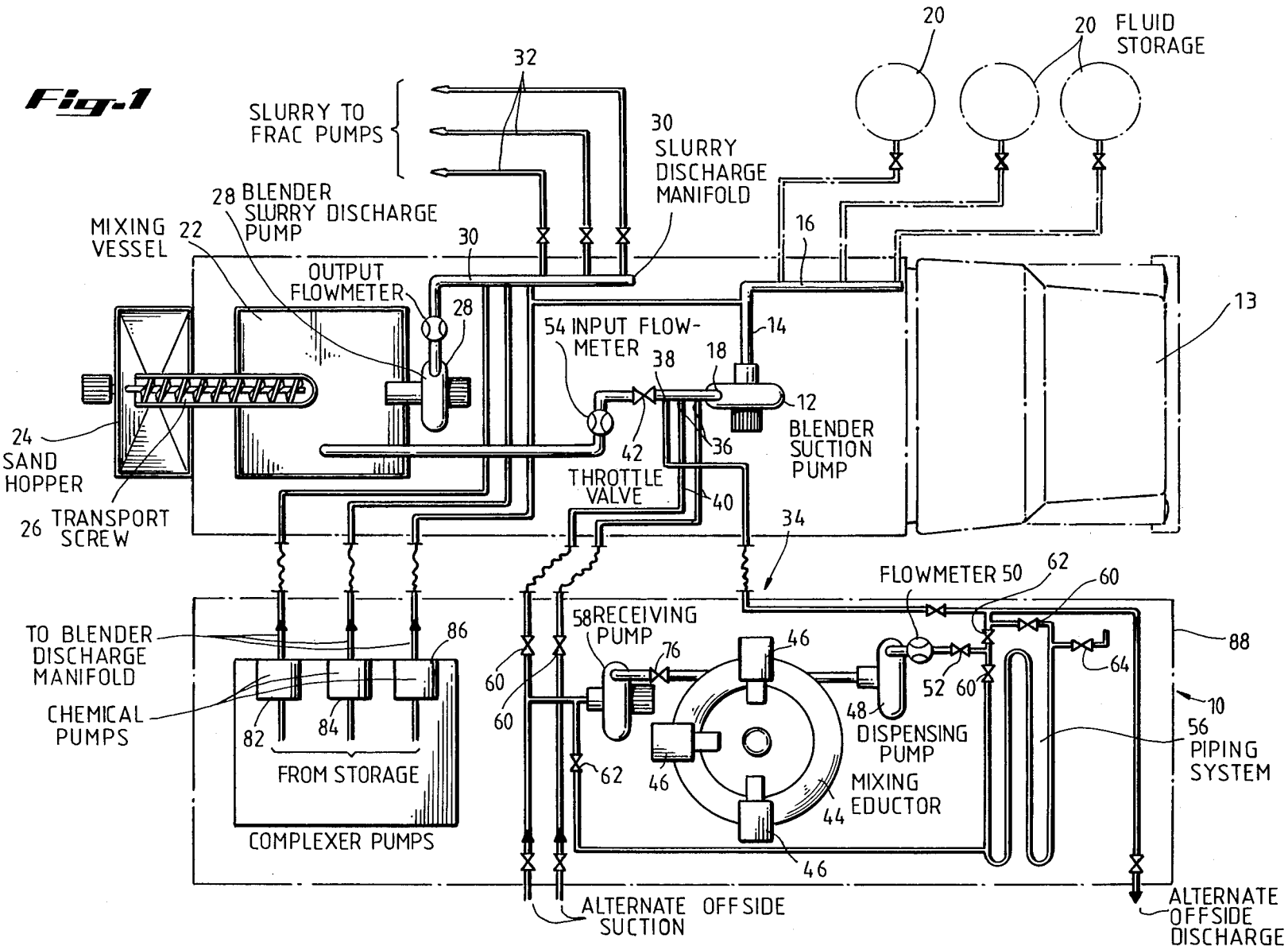
FIG. 1 is a schematic diagram of the present invention.

Referring now to the drawings, particularly to FIG. 1, the reference numeral 10 generally indicates the apparatus of the present invention.

A blender pump 12 is provided, such as on a truck 13, which has a suction intake 14 connected to a suction pump manifold 16, and a discharge outlet 18. The suction pump manifold 16 is adapted to be connected to any suitable supply of base fluid such as water, various types of hydrocarbons, or well fluids which may be stored in frac fluid storage means such as tanks 20. The discharge outlet 18 is connected to a particle mixing vessel or vat 22 which is supplied with a suitable type of propping particle such as sand which may be supplied from a hopper 24 by means of a conveyor such as a sand screw 26. The output from the mixing vessel 22 is connected to a slurry discharge pump 28 and in turn to a slurry discharge manifold 30 which is connected to slurry lines 32 for connection to conventional frac pumps for injecting the mixture into a well. The pumps 12 and 28 may be centrifugal pumps.

The above described blending apparatus is generally conventional except that the fluids stored in the storage tanks 20 would be already gelled fluid which would be preprepared and held in waiting for the well fracturing job. This is disadvantageous for several reasons: the gelled premix fluid may not all be used and thus the leftover prepared fluid which is expensive, will be an economic loss, and disposing of any leftover gelled fluids would be an extra cost, and the stored gelled frac fluid would be subject to degradation.

The present invention is directed to using a gelling unit generally indicated by the reference numeral 34 which is used in combination with the above described blending apparatus to blend and gel base fluid when and as needed. The gelling unit 34 includes an inlet 36 and an outlet 38. The inlet 36 may consist of one or more lines 40 which are connected to the discharge outlet 18 of the blender pump 12, preferably upstream of a throttle valve 42. The outlet 38 of the gelling unit 34 is connected, preferably to the upstream side of the throttle valve 42, but downstream of the inlets 36. However, inlet 36 and outlet 38 could be connected downstream of the throttle valve 42, but in such event they could become contaminated from the mixing vessel 22. The gelling unit 34 includes a mixing eductor 44 positioned between the inlets 36 and the outlet 38. One or more dry chemical feeders 46, at least one of which is a dry gel feeder, is connected to the mixing eductor 44 for feeding gel and other dry chemicals into the eductor 44 for mixing with the incoming base fluid. A dispensing pump 48 is connected between the mixing eductor 44 and the gelling unit outlet 38 and has a higher outlet pressure capacity than the discharge pressure of the blender pump 12 for insuring that the gelled frac fluid is properly circulated, blended and pumped downstream. A flow meter 50 and valve 52 are connected to the outlet of the dispensing pump 48 for measuring and controlling the flow rate through the gelling unit 34.

The dry chemical feeder pumps 46 may be K-Tron twin screw volumetric feeders. A plurality of such feeders 46 allows flexibility in feeding additional chemical additives into well stimulation fluid depending upon the products to be blended.

The throttle valve 42 controls the flow of base fluid received, such as from the storage tanks 20, and the mixed gelled frac fluid from the gelling unit 34 whose total flow is measured by flow meter 54 and is supplied to the mixing vat 22. By noting the output of the flow meters 50 and 54, the proper blending of the amount of gel in the gelling unit 34 to the total amount of frac fluid used can be properly proportioned and controlled.

While the gelling agent and base fluid is thoroughly mixed in the mixing eductor 44, it is desirable that the mixing time be suitably increased, for example one minute, to insure that the gelling agent is hydrated before it is delivered back to the main blender system. Therefore, a discharge manifold 56 is provided connected to the outlet of the dispensing pump 48 having a volume sufficient for holding the mixture of gel and frac fluid a length of time sufficient for the gel to hydrate prior to reaching the outlet 38 of the gelling unit 34. For example, a piping manifold of fourteen inch pipe having a length of 115 feet would generally be sufficient to allow hydration.

Preferably, a receiving pump 58 is provided between the gelling unit inlet 36 and the mixing eductor 44 and with suitable valves in the gelling unit inlet 36 and outlet 38 for emptying the gelling unit 34 of materials at the end of an opertion. For example, various valves 60 and 62 are provided. During normal blending operations, the valves 60 are open and the valves 62 are closed. At the end of an operation, the valves 60 are closed and the valves 62 are open along with an air vent 64 in the discharge manifold 56 allowing the receiving pump 58 to empty the discharge manifold 56 and allowing the dispensing pump 48 to empty the eductor 44 directly into the blending system.

Figure 2:
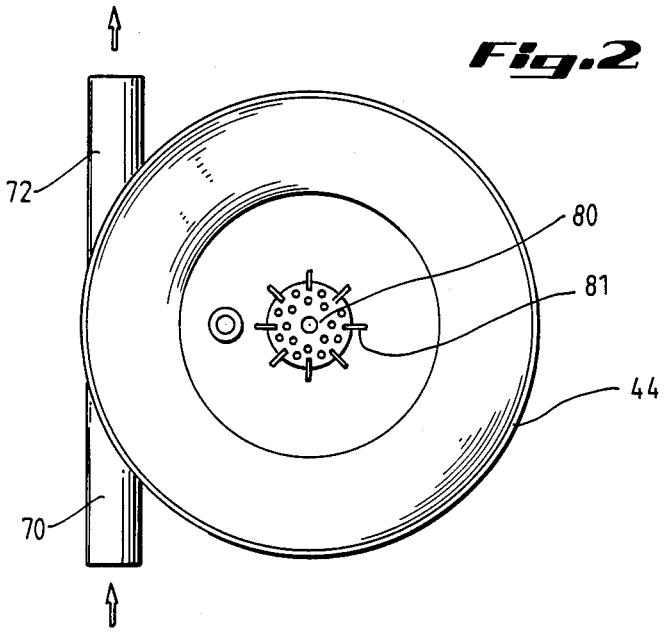
FIG. 2 is a top elavational view of the mixing eductor tank.
Figure 3:
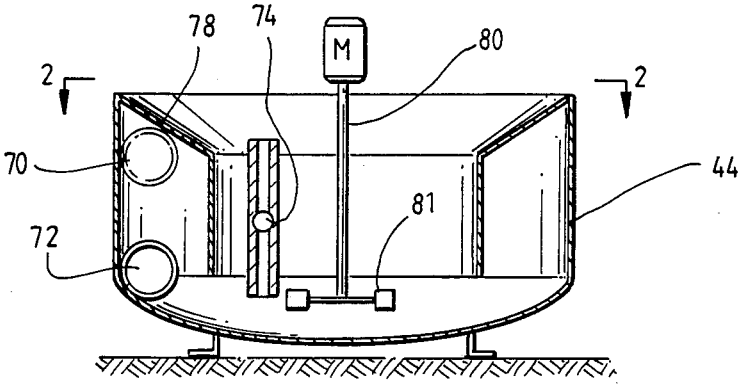
FIG. 3 is a cross-sectional view of the eductor tank.

Referring now to FIGS. 2 and 3, the mixing eductor 44 is best seen as being a circular tank having a tangentially directed inlet port 70 and an outlet port 72. A liquid level measuring float 74 is provided in the eductor 44 for measuring the fluid level therein and for controlling a valve 76 (FIG. 1) which limits the discharge by the receiving pump 58 into the mixing eductor 44. A splash shield 78 is provided around the outer edge of the eductor 42 above the inlet port 70 for preventing the rotating inlet fluid from splashing out of the eductor 44 but still providing an opening 80 in the top of the eductor 44 for the admission of the gel and possibly other chemical additives from the feeders 46 (FIG. 1). While the tangential flow of the incoming fluid through the inlet port 70 may be sufficient to thoroughly mix the gel and the frac fluid in the eductor 44 it may be desirable to provide a mixing paddle 81 positioned in the eductor 44 for insuring the thorough mixture of the added chemicals with the frac fluid.

Referring now to FIG. 1, one or more chemical injection pumps 82, 84, and 86 may be provided such as Sherwood diaphragm pumps for injecting fluid chemicals as may be required into the system. Preferably, one of the chemical injection pumps, such as 86, may be directed to inject chemicals into the suction pump manifold 16 such as for injecting acid into a water type frac fluid. The other chemical injection pumps 82 and 84 may inject other chemical additives into the slurry discharge manifold 30.

For convenience, the gelling unit 34 and chemical pumps 82, 84 and 86 may, if desired, be positioned on a movable trailer 88 which can be conveniently located and connected to the blender system. It is to be noted that fluid lines are connected between the gel inlets 36 and outlet 38 to either side of the trailer 88 whereby the trailer 88 may be positioned on either side of the truck 13.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts, will be readily apparent to those skilled in the art and which are encompassed within the spirit of the invention and the scope of the appended claims,

What is claimed is:

1. A well stimulation fluid blending apparatus comprising, a blender pump having a suction intake adapted to be connected to a supply of frac fluid and having a discharge outlet, a throttle valve connected to the discharge outlet of the blender pump, an input flow meter connected to the discharge outlet downstream of the throttle valve, a particle mixing vat connected to the discharge outlet downstream of the flow meter, a gelling unit having an inlet and an outlet, the inlet of the gelling unit connected to the discharge outlet of the blender pump, the output of the gelling unit connected to the discharge side of the blender pump and downstream of the inlet of the gelling unit, said gelling unit including a mixing eductor positioned between the inlet and outlet of the gelling unit, at least one dry chemical gel feeder connected to the eductor for feeding gel into the eductor for mixing with the incoming frac fluid, a dispensing pump connected between the mixing eductor and the gelling unit outlet, said dispensing pump having a higher outlet pressure than the discharge pressure of the blender pump, and a flow meter and valve connected to the outlet of the dispensing pump for measuring and controlling the flow rate through the gelling unit.

2. The apparatus of claim 1 including, a discharge manifold connected to the outlet of the dispensing pump having a volume sufficient for holding the mixture of gel and frac fluid a length of time sufficient for the gel to hydrate prior to reaching the outlet of the gelling unit.

3. The apparatus of claim 2 wherein the discharge manifold includes an openable and closable air vent.

4. The apparatus of claim 1 including, a receiving pump connected between the gelling unit inlet and the mixing eductor, and valves in the gelling unit inlet and outlet for emptying the gelling unit of materials.

5. The apparatus of claim 1 wherein said mixing eductor is a circular tank having a tangentially directed inlet port for receiving the frac fluid, liquid level measuring means in the tank, and valve means connected to the inlet port and to the liquid level measuring means for controlling the fluid level in the tank.

6. The apparatus of claim 5 wherein the tank includes an outlet port at a lower elevation than the inlet port.

7. The apparatus of claim 4 including, a receiving pump connected between the gelling unit inlet and the mixing eductor, and valves in the gelling unit inlet and outlet for emptying the gelling unit of materials.

8. The apparatus of claim 1 including at least one chemical liquid pump connected to the inlet of the blender pump.

9. The apparatus of claim 1 wherein the inlet and outlet of the gelling unit is connected to the discharge outlet of the blender pump at a point upstream of the throttle valve.

* * * * *